US005409571A

United States Patent [19]

Togo et al.

[11] Patent Number: 5,409,571

[45] Date of Patent: Apr. 25, 1995

[54] SCALE DEPOSIT INHIBITOR FOR KRAFT DIGESTERS AND METHOD FOR CONTROLLING SCALE DEPOSITION IN KRAFT DIGESTERS

[75] Inventors: Akira Togo; Takanori Shibata, both of Mie, Japan

[73] Assignee: Hakuto Co., Ltd., Tokyo, Japan

[21] Appl. No.: 189,649

[22] Filed: Feb. 1, 1994

[51] Int. Cl.[6] ..... D21C 7/14

[52] U.S. Cl. ..... 162/48; 162/76; 162/80; 210/698; 210/701

[58] Field of Search ..... 162/4, 5, 14, 15, 16, 162/30.11, 39, 70, 72, 76, 80, 48, 189; 210/696, 698, 701

[56] References Cited

U.S. PATENT DOCUMENTS

| | | | |
|---|---|---|---|
| 2,957,931 | 10/1960 | Hamilton | 260/403 |
| 3,516,910 | 6/1970 | Engman | 203/7 |
| 3,558,499 | 7/1969 | Galvin | 252/137 |
| 3,684,779 | 8/1972 | Rapko | 260/80.71 |
| 3,965,027 | 6/1976 | Boflandi et al. | 210/58 |
| 4,046,707 | 9/1977 | Smith et al. | 252/181 |
| 4,127,483 | 12/1978 | Smith et al. | 210/58 |
| 4,159,946 | 7/1979 | Smith et al. | 210/58 |
| 4,239,648 | 12/1980 | Marshall et al. | 210/749 |
| 4,372,870 | 2/1983 | Snyder et al. | 252/180 X |
| 4,452,703 | 6/1984 | Ralston et al. | 210/701 |
| 4,554,307 | 11/1985 | Farrar et al. | 524/425 |
| 4,561,982 | 12/1985 | Kuriyama et al. | 252/180 |
| 4,563,284 | 1/1986 | Amjad | 426/271 |
| 4,589,995 | 5/1986 | Fukumoto et al. | 252/180 |
| 4,617,139 | 10/1986 | Robb et al. | 252/180 |
| 4,659,793 | 4/1987 | Yang | 526/317 |
| 4,676,911 | 6/1987 | Fong | 210/700 |
| 4,732,707 | 3/1988 | Naik et al. | 252/527 |
| 4,799,995 | 1/1989 | Crump et al. | 162/76 |
| 4,914,167 | 4/1990 | Hambrecht et al. | 526/317 |
| 4,915,845 | 4/1990 | Leighton et al. | 526/287 |
| 4,931,188 | 6/1990 | Chen | 210/697 |
| 4,936,987 | 6/1990 | Pevinski et al. | 260/513 |
| 5,077,361 | 12/1991 | Hughes et al. | 526/233 |
| 5,135,677 | 8/1992 | Yamaguchi et al. | 252/180 |
| 5,185,413 | 2/1993 | Yoshinaga et al. | 526/233 |
| 5,216,099 | 6/1993 | Hughes et al. | 526/279 |
| 5,232,603 | 8/1993 | Denzinger et al. | 210/698 |
| 5,254,286 | 10/1993 | Gill et al. | 252/180 |
| 5,256,302 | 10/1993 | Perez et al. | 210/201 |
| 5,256,746 | 10/1993 | Blankenship et al. | 526/233 |

FOREIGN PATENT DOCUMENTS 2-53551 11/1990 Japan .

OTHER PUBLICATIONS

"A polyelectrolyte for deposit control in the Kamyr digester" (Canadian Pulp and Paper Industry, Apr., 1976, pp. 25–27).

"Formation of calcium scale in a continuous digester" (Tappi, Apr. 1980, vol. 63, No.4, pp. 125–127).

"Structure and composition of scale in continuous kraft digesters" (Svensk Papperstidning arg. 75, No. 2, 31 Jan. 1972, pp. 65–70).

*Primary Examiner*—W. Gary Jones
*Assistant Examiner*—Mark De Simone
*Attorney, Agent, or Firm*—Sughrue, Mion, Zinn, Macpeak & Seas

[57] ABSTRACT

A scale deposit inhibitor and a method for continuously controlling scale deposition applicable to a digester and its peripheral equipment used in kraft pulp manufacture are disclosed, the scale deposit inhibitor comprising a maleic acid-acrylic acid-hypophosphorous acid terpolymer having a maleic acid unit to acrylic acid unit molar ratio of 1:4 to 4:1, a hypophosphorous acid unit content of 1 to 12 mol %, and a weight average molecular weight of 500 to 10000. The scale deposit inhibitor is added to a cooking liquor in a concentration of 0.01 to 10 ppm per ppm of a calcium ion in the cooking liquor.

4 Claims, No Drawings

SCALE DEPOSIT INHIBITOR FOR KRAFT DIGESTERS AND METHOD FOR CONTROLLING SCALE DEPOSITION IN KRAFT DIGESTERS

FIELD OF THE INVENTION

This invention relates to an agent for continuously controlling scale deposition in a digester and its peripheral equipment (e.g., piping) used in a kraft pulp manufacturing process and to a method of scale deposit control using the same.

BACKGROUND OF THE INVENTION

Kraft pulp is produced by cooking wood chips in an aqueous medium mainly comprising sodium hydroxide and sodium sulfide in high temperature under high pressure to remove lignin from the chips. The typical composition of the cooking liquor (white liquor) is 55 to 100 g/l of sodium hydroxide, 18 to 45 g/l of sodium sulfide, and 10 to 30 g/l of sodium carbonate, each in terms of $Na_2O$, which is sometimes used as partly diluted with a black liquor. The cooking temperature is about 170° C.

The calcium ion dissolved out of wood chips reacts with a carbonate ion in the cooking liquor to form calcium carbonate in the system, which is precipitated and deposited on the inner wall of a digester and subsequent tanks and pipes. Calcium carbonate scale deposited in various zones of a continuous digester, especially in the upper cooking zone, the heat exchangers and the digester screens causes various operational problems, such as reduction in thermal efficiency, hindrance to the flow of the liquid and pulp, reduction in productivity, and non-uniform pulp quality, and necessitates frequent cleaning.

The scale is generally removed by planned cleaning with an acid solution. This method is, however, disadvantageous in that scale removal itself takes much labor and that suspension of operation causes a production loss and an enormous energy loss.

It has therefore been demanded to develop a technique for continuously controlling scale deposition and thereby minimizing the necessity of scale removal. In this line, it has been proposed to use a maleic acid polymer (see JP-B-2-53551, the term "JP-B" as used herein means an "examined published Japanese patent application") or polyaminopoly(alkylenephosphonic acids) and nonionic surfactants of polyalkoxyalkylphenols (see U.S. Pat. No. 4,799,995) as a scale deposit inhibitor. However, none of the inhibitors proposed gives satisfactory results for control of scale deposition, and there still has been a demand for a scale deposit inhibitor of higher effect.

SUMMARY OF THE INVENTION

An object of the present invention is to control an effective scale deposit inhibitor which can be applied to a digester used in kraft pulp manufacture and a method for continuously controlling scale deposition in the digester using the inhibitor.

As a result of extensive investigations, the present inventors have found that a terpolymer comprising unsaturated carboxylic acid units, such as maleic acid and acrylic acid, and a small proportion of a hypophosphorous acid unit gives a markedly high effect on control of scale formation in a cooking liquor. The present invention has been completed based on this finding.

The present invention relates to a scale deposit inhibitor for a digester used in kraft pulp manufacture, which comprises a terpolymer comprising (A) a maleic acid unit, (B) an acrylic acid unit, and (C) a hypophosphorous acid unit having an (A) to (B) molar ratio of from 1:4 to 4:1, a (C) content of from 1 to 12 mol %, and a weight average molecular weight of from 500 to 10000.

The present invention also relates to a method for controlling scale deposition in a continuous kraft digester, which comprises adding the above-mentioned scale deposit inhibitor to a cooking liquor in the digester to a concentration of from 0.01 to 10 ppm per ppm of a calcium ion present in the cooking liquor.

DETAILED DESCRIPTION OF THE INVENTION

The terpolymer according to the present invention has a maleic acid unit to acrylic acid unit molar ratio of from 1:4 to 4:1, preferably from 1:2 to 4:1, and more preferably from 1:1 to 3:1, a hypophosphorous acid unit content of from 1 to 12 mol %, and preferably from 2 to 5 mol %, and a weight average molecular weight of from 500 to 10000, and preferably from 1000 to 5000. The above-described ranges for monomer unit ratio and molecular weight are optimum values found as a result of the inventors' experiments. Terpolymers out of these ranges are not sufficient enough in the effect to be economically acceptable. According to the present inventors' study, the monomer unit ratio and molecular weight have a great influence on the effect. Although hypophosphorous acid acts as the bifunctional, it does not function as a chain extender in a vinyl polymerization system and therefore only one hypophosphorous acid unit is incorporated per polymer molecule. That is, an increase of the proportion of hypophosphorous acid used necessarily results in reduction in molecular weight, and the proportion of hypophosphorous acid used confines the upper limit of the molecular weight of the resulting terpolymer. Thus, a polymer having incorporated therein a hypophosphorous acid unit exhibits a sufficient effect while having a low molecular weight. Because of the low molecular weight of the polymer, a solution using the polymer also has a low viscosity, which is of great advantage for the manufacture and the handling.

The maleic acid, acrylic acid, and hypophosphorous acid may each have a salt form, such as an alkali metal salt (e.g., a sodium salt or a potassium salt) or an ammonium salt.

The way for preparing the terpolymer of the present invention is not particularly restricted. For example, an alkali metal hydroxide (i.e., sodium hydroxide) is added to an aqueous solution of maleic acid or a salt thereof, a hypophosphite, acrylic acid and a polymerization initiator are gradually added thereto at a temperature of from 80° to 110° C., with stirring under a nitrogen atmosphere, and the mixture was further kept stirring at the same temperature for 2 to 4 hours.

The polymerization initiator to be used is not particularly limited and can be selected according to a polymerization process from among substances capable of decomposing under the reaction conditions to generate a free radical. Examples of suitable polymerization initiators include peroxides, such as hydrogen peroxide, sodium persulfate and butyl hydroperoxide, and azo compounds, such as azobisisobutyronitrile, with hydrogen peroxide and a persulfate being preferred. The amount of the polymerization initiator used is subject to variation according to the kind. Sodium persulfate, for example, is generally used in an amount of from 0.5 to 10 mol %, and preferably from 1 to 5 mol %, based on the unsaturated carboxylic acid monomers.

Water is the most preferred reaction solvent for polymerization. Organic solvents, such as alcohols and dioxane, may also be used as a solvent.

The polymerization is preferably carried out at a temperature of from 80° to 110° C. At temperatures lower than 80° C., considerably large quantities of hypophosphorous acid and other monomers remain unreacted.

After completion of the reaction, the resulting reaction solution assuming a pale yellow color can be used as a scale deposit inhibitor either as such or as appropriately diluted with water. The viscosity of the resulting polymer solution varies depending on the concentration and the molecular weight of the polymer. For example, the viscosity of a 30 wt % aqueous solution of a polymer having a molecular weight of 500 or 5000 was 29 cps or 400 cps, respectively.

The scale deposit inhibitor according to the present invention is added to a cooking liquor in a digester in a concentration of from 0.01 to 10 ppm, preferably from 0.05 to 3 ppm, and more preferably from 0.25 to 3 ppm, per ppm of a calcium ion present in the cooking liquor. As a practical matter there is normally no advantage to be gained from using less than 0.01 ppm or more than 10 ppm. At concentrations less than 0.01 ppm, a sufficient effect cannot be obtained. Addition of an amount exceeding 10 ppm brings about no further improvement and is economically unfavorable. It is recommended to occasionally measure the calcium ion concentration of an aliquot taken out of the liquid in a digester and to adjust the concentration of the scale deposit inhibitor to an optimum level.

The manner of addition of the scale deposit inhibitor into a digester is not particularly restricted. It is convenient in practice that the inhibitor is injected to a white liquor to be supplied to a digester and/or a circulating cooking liquor. If desired, the scale deposit inhibitor may be injected in combination with other optional additives as far as the essential objects of the present invention are accomplished.

The mechanism of action of the scale deposit inhibitor of the present invention is explained below. Calcium carbonate formed in a digester is gradually precipitated into scale as its concentration increases. It is considered that the scale deposit inhibitor of the present invention is adsorbed onto the growing crystal faces and enters the crystal lattices. Resulting discontinuity in the lattice structure causes crystal growth to stop and may even result in the fracturing of existing scale deposits. As a result, calcium carbonate is hardly precipitated, and, even if precipitated, the crystals are so grossly deformed not to form scale. The polymers of this invention are effective as threschold scale inhibitors. This means that the inhibitor is effective at inhibiting scale formation at substantially less than a stoichiometric ratio compared with the scale-forming cation. Threschold scale inhibition is well known in the water treatment field and is normally the route used to inhibit scale formation.

The present invention will now be illustrated in greater detail with reference to Examples, but the present invention should not be construed as being limited thereto.

EXAMPLE 1

Preparation of Polymer

Polymers A to S having the characteristics shown in Table 1 below were prepared.

To take an instance, polymer F was prepared as follows. In a 500 ml five-necked flask were charged 23.3 g of maleic anhydride and 50 ml of water, and 32.8 g of a 50 wt % sodium hydroxide aqueous solution was gradually added thereto to dissolve the maleic anhydride. To the solution was further added 2.6 g of sodium hypophosphite monohydrate. To the flask were fitted a condenser, a stirrer, a thermometer, a tube for introducing nitrogen, and two dropping funnels via a Y-tube. The solution was heated to 80° C. while introducing nitrogen, and a solution of 3.4 g of sodium persulfate in 20 g of water and 16.8 g of acrylic acid were separately added thereto through the two dropping funnels each over 1.5 hours. After the addition, the mixture was heated at 80° C. for an additional period of 2.5 hours, followed by cooling to obtain a polymer aqueous solution. No residual monomers was detected by ion chromatography, revealing nearly 100% reaction of the monomers.

TABLE 1

| Scale Deposit Inhibitor | Reaction Molar Ratio: Hypophosphorous Acid (mol %) | Maleic Acid (A) (mol %) | Acrylic Acid (B) (mol %) | (A):(B) Molar Ratio | Molecular Weight | Remark |
|---|---|---|---|---|---|---|
| Polymer A | 4.3 | 31.9 | 63.8 | 1:2 | 2800 | Invention |
| Polymer B | 6.3 | 31.3 | 62.5 | 1:2 | 1700 | " |
| Polymer C | 10.0 | 30.0 | 60.0 | 1:2 | 1360 | " |
| Polymer D | 11.8 | 29.4 | 58.8 | 1:2 | 1000 | " |
| Polymer E | 2.6 | 48.7 | 48.7 | 1:1 | 3700 | " |
| Polymer F | 5.0 | 47.5 | 47.5 | 1:1 | 1800 | " |
| Polymer G | 10.0 | 45.0 | 45.0 | 1:1 | 1250 | " |
| Polymer H | 10.0 | 60.0 | 30.0 | 2:1 | 940 | " |
| Polymer I | 0.0 | 0.0 | 100.0 | — | 5000 | Comparison |
| Polymer J | 10.0 | 0.0 | 90.0 | — | 900 | " |
| Polymer K | 20.0 | 0.0 | 80.0 | — | 170 | " |
| Polymer L | 0.0 | 30.0 | 70.0 | 1:2.3 | 6500 | " |
| Polymer M | 18.2 | 27.3 | 54.5 | 1:2 | 500 | " |
| Polymer N | 20.0 | 26.7 | 53.3 | 1:2 | 280 | " |
| Polymer O | 0.0 | 50.0 | 50.0 | 1:1 | 1800 | " |
| Polymer P | 20.0 | 40.0 | 40.0 | 1:1 | 200 | " |
| Polymer Q | 20.0 | 60.0 | 30.0 | 2:1 | 530 | " |
| Polymer R | 25.0 | 50.0 | 25.0 | 2:1 | ≦200 | " |

TABLE 1-continued

| Scale Deposit Inhibitor | Reaction Molar Ratio: Hypophosphorous Acid (mol %) | Maleic Acid (A) (mol %) | Acrylic Acid (B) (mol %) | (A):(B) Molar Ratio | Molecular Weight | Remark |
|---|---|---|---|---|---|---|
| Polymer S* | 0.0 | 100.0 | 0.0 | — | 600 | " |

Note: *A scale deposit inhibitor as disclosed in JP-B-2-53551

Evaluation

Inhibition of calcium carbonate precipitation in a highly alkaline white liquor was evaluated according to the following test methods.

1) Effect on Inhibition of Calcium Carbonate Precipitation at 100° C.:

Calcium chloride was added to 200 ml of a model white liquor (an aqueous solution consisting of 8.0 wt % NaOH, 4.0 wt % $Na_2S$, 3.5 wt % $Na_2CO_3$, 0.5 wt % KOH, and 84.0 wt % ion-exchanged water) to a final calcium ion concentration of 100 ppm. Each of the scale deposit inhibitors prepared or available was added to the mixture to a prescribed concentration. The resulting mixture was heated at 100° C. for form a uniform solution. After allowing to stand at 100° C. for 2 hours, the liquid was filtered by suction through a filter paper for quantitative determination (Filter No. 6) manufactured by Advantec Toyo Kaisha Ltd. The filter paper was dried, and the calcium carbonate on the filter paper was weighed to obtain the amount of precipitate (A). As a control, the amount of precipitate (B) of the system containing no scale deposit inhibitor was obtained. A percent inhibition of calcium carbonate precipitation was calculated according to an equation:

$$\text{Percent Inhibition (\%)} = (1 - A/B) \times 100$$

The results obtained are shown in Tables 2 and 3 below.

TABLE 2

| Scale Deposit Inhibitor: 50 ppm (0.5 ppm/ppm-$Ca^{2+}$) | | | |
|---|---|---|---|
| Invention | | Comparison | |
| Scale Deposit Inhibitor | Percent Inhibition (%) | Scale Deposit Inhibitor | Percent Inhibition (%) |
| Polymer A | 97.0 | Polymer I | 6.9 |
| Polymer B | 97.5 | Polymer J | 1.2 |
| Polymer C | 97.9 | Polymer K | 3.2 |
| Polymer D | 94.8 | Polymer L | 68.0 |
| Polymer E | 98.4 | Polymer M | 5.4 |
| Polymer F | 95.1 | Polymer N | 4.1 |
| Polymer G | 97.0 | Polymer O | 66.4 |
| Polymer H | 96.8 | Polymer P | 2.9 |
| | | Polymer Q | 47.3 |
| | | Polymer R | 1.7 |
| | | Polymer S | 92.2 |
| | | DTPMP + Surfactant* | 42.5 |

Note: *A mixture of polyaminopoly(methylenephosphonic acid) and polyethoxynonylphenol (10 mole ethylene oxide) with a mixing ratio by weight of the former component to the latter component of 2:1, which is a scale deposit inhibitor as disclosed in U.S. Pat. No. 4,799,995. The concentration of such an inhibitor as used herein is based on a total weight of both the components thereof.

TABLE 3

| Percent Inhibition (%) at Varied Inhibitor Concentration | | | | |
|---|---|---|---|---|
| Scale Deposit Inhibitor | Concentration of Scale Deposit Inhibitor: 25 ppm (0.25 ppm)* | 10 ppm (0.10 ppm) | 5 ppm (0.05 ppm) | 1 ppm (0.01 ppm) |
| Polymer A | 94.3 | 94.1 | 92.4 | 91.7 |
| Polymer B | 94.3 | 92.9 | 79.3 | 20.0 |

TABLE 3-continued

| Percent Inhibition (%) at Varied Inhibitor Concentration | | | | |
|---|---|---|---|---|
| Scale Deposit Inhibitor | Concentration of Scale Deposit Inhibitor: 25 ppm (0.25 ppm)* | 10 ppm (0.10 ppm) | 5 ppm (0.05 ppm) | 1 ppm (0.01 ppm) |
| Polymer C | 92.2 | 9.5 | — | — |
| Polymer E | 95.8 | 95.8 | 92.2 | 91.9 |
| Polymer F | 94.2 | 94.0 | 93.6 | 93.0 |
| Polymer G | 93.8 | 82.4 | 2.5 | — |
| Polymer H | 94.6 | 93.9 | 92.6 | 3.1 |
| Polymer L | 44.2 | 8.0 | — | — |
| Polymer O | 65.7 | 9.6 | — | — |
| Polymer S | 29.6 | 7.9 | — | — |
| DTPMP + Surfactant | 21.3 | 5.2 | — | — |

Note: *Values in the parentheses are concentrations per ppm of $Ca^{2+}$.

2) Effect on Inhibition of Calcium Carbonate Precipitation at 180° C.:

A hundred milliliters of a model white liquor (an aqueous solution consisting of 8.0 wt % NaOH, 3.5 wt % $Na_2CO_3$, 0.5 wt % KOH, and 88.0 wt % ion-exchanged water) were heated to 100° C., and calcium chloride was added thereto to a final calcium ion concentration of 50 ppm. Each of the scale deposit inhibitors prepared was added to the mixture to a prescribed concentration. The resulting mixture was kept still in an autoclave set at 180° C. for 50 minutes. The autoclave was rapidly cooled by dipping in tap water, and the liquid was passed through a filter paper for quantitative determination (No. 6) by gravity filtration. The residual calcium ion concentration of the filtrate was determined by atomic-absorption spectroscopy. The results obtained are shown in Table 4 below.

TABLE 4

| Residual $Ca^{2+}$ + Concentration (ppm) | | | | |
|---|---|---|---|---|
| Scale Deposit Inhibitor | Concentration of Scale Deposit Inhibitor: 25 ppm (0.50 ppm)* | 10 ppm (0.20 ppm) | 5 ppm (0.10 ppm) | No Addition |
| Polymer A | 22.6 | 20.3 | 15.9 | 8.0 |
| Polymer B | 23.7 | 21.0 | 16.9 | " |
| Polymer E | 30.4 | 30.4 | 26.8 | " |
| Polymer F | 27.3 | 24.6 | 21.7 | " |
| Polymer H | 30.5 | 30.1 | 16.7 | " |
| Polymer L | 13.2 | 11.0 | 11.6 | " |
| Polymer O | 12.4 | 11.4 | 10.5 | " |

Note: *Values in the parentheses are concentrations per ppm of $Ca^{2+}$.

It is seen from the results in Tables 2, 3, and 4 that the hypophosphorous acid-containing polymers according to the present invention exhibit a markedly high inhibitory effect on calcium carbonate precipitation. Polymer S, while having a high effect when added in a high concentration (see Table 2), is far less effective than those of the present invention when added in a reduced concentration (see Table 3). Reviewing polymers B, F, and 0 having substantially the same molecular weight, polymers B and F each containing hypophosphorous acid are much superior to polymer O containing no hypophosphorous acid.

As described and demonstrated above, scale deposition in a digester in kraft pulp manufacture can be controlled in a continuous manner by applying the scale deposit inhibitor and the scale deposit inhibition method according to the present invention to the digesting step. It follows that a run length of practical continuous operation of a digester can be extended to achieve an improvement in productivity, uniform quality of pulp, and a reduction in energy loss. Further, troubles arising from scale deposit are greatly diminished, which makes a valuable contribution to improvement of operating efficiency.

While the invention has been described in detail and with reference to specific examples thereof, it will be apparent to one skilled in the art that various changes and modifications can be made therein without departing from the spirit and scope thereof.

What is claimed is:

1. A scale deposit inhibitor for a digester used in kraft pulp manufacture, which comprises a terpolymer comprising a maleic acid unit, an acrylic acid unit, and a hypophosphorous acid unit having a maleic acid unit to acrylic acid unit molar ratio of from 1:4 to 4:1, a hypophosphorous acid unit content of from 1 to 12 mol %, and a weight average molecular weight of from 500 to 10000.

2. The scale deposit inhibitor as claimed in claim 1, wherein said terpolymer has a maleic acid unit to acrylic acid unit molar ratio of from 1:2 to 4:1, a hypophosphorous acid unit content of from 2 to 5 mol %, and a weight average molecular weight of from 1000 to 5000.

3. A method for controlling scale deposition in a digester used in kraft pulp manufacture, which comprises adding a scale deposit inhibitor comprising a terpolymer comprising a maleic acid unit, an acrylic acid unit, and a hypophosphorous acid unit having a maleic acid unit to acrylic acid unit molar ratio of from 1:4 to 4:1, a hypophosphorous acid unit content of from 1 to 12 mol %, and a weight average molecular weight of from 500 to 10000 to a cooking liquor in a digester to a concentration of from 0.01 to 10 ppm per ppm of a calcium ion present in said cooking liquor.

4. The method for controlling scale deposition as claimed in claim 3, wherein said concentration is from 0.05 to 3 ppm per ppm of the calcium ion.

* * * * *